US008980168B2

(12) United States Patent
Beals

(10) Patent No.: US 8,980,168 B2
(45) Date of Patent: Mar. 17, 2015

(54) REDUCED BERYLLIUM CASTING ALLOY

(75) Inventor: Randolf S. Beals, Grand Ledge, MI (US)

(73) Assignee: Materion Brush Inc., Mayfield Heights, OH (US)

( * ) Notice: Subject to any disclaimer, the term of this patent is extended or adjusted under 35 U.S.C. 154(b) by 408 days.

(21) Appl. No.: 13/398,234

(22) Filed: Feb. 16, 2012

(65) Prior Publication Data

US 2013/0216424 A1 Aug. 22, 2013

(51) Int. Cl.
*C22C 25/00* (2006.01)
*C22C 30/00* (2006.01)

(52) U.S. Cl.
CPC ..... *C22C 25/00* (2013.01); *C22C 30/00* (2013.01)
USPC ..... 420/401; 420/580; 148/437

(58) Field of Classification Search
CPC ..... C22C 25/00; C22C 30/00
USPC ..... 420/401, 580; 148/437, 400
See application file for complete search history.

(56) References Cited

U.S. PATENT DOCUMENTS

| | | | | |
|---|---|---|---|---|
| 3,664,889 | A | 5/1972 | McCarthy et al. | |
| 5,421,916 | A | 6/1995 | Nachtrab et al. | |
| 5,603,780 | A | 2/1997 | Nachtrab et al. | |
| 5,642,773 | A | 7/1997 | Grensing et al. | |
| 5,667,600 | A | 9/1997 | Grensing et al. | |
| 6,042,658 | A * | 3/2000 | Grensing et al. | 148/437 |
| 6,312,534 | B1 * | 11/2001 | Grensing | 148/437 |
| 6,656,421 | B2 | 12/2003 | Ochiai et al. | |
| 7,029,626 | B2 | 4/2006 | Beals | |
| 7,445,751 | B2 | 11/2008 | Beals | |

* cited by examiner

*Primary Examiner* — Jie Yang
(74) *Attorney, Agent, or Firm* — Calfee, Halter & Griswold, LLP

(57) ABSTRACT

The beryllium content of beryllium aluminum alloys suitable for investment casting which contain a small but suitable amount of silver can be significantly reduced without adversely affecting their thermal or investment casting properties by including significantly more silicon in the alloy than done in the past.

13 Claims, No Drawings

REDUCED BERYLLIUM CASTING ALLOY

BACKGROUND

This invention relates to improved beryllium aluminum alloys for use in investment casting.

As described in commonly-assigned U.S. Pat. No. 5,667,600 to Grensing et al., the disclosure of which is incorporated herein by reference, investment casting is a type of casing normally used to make metal parts of complex shape. "Investment casting" connotes that the casting obtained has a "near net shape," i.e., a shape which is very near to the shape of the final product to be made. Investment casting is desirable because it essentially eliminates the extensive machining that would otherwise be necessary to transform a casting into its final desired shape.

Beryllium and aluminum have widely different melting temperatures, 1289° C. and 660° C. respectively. This makes investment casting of beryllium aluminum alloys very difficult, because this large difference in melting temperatures leads to large differences between the liquidus and solidus temperatures of these alloys. See, U.S. Pat. No. 5,603,780 to Nachtrab et al., the disclosure of which is also incorporated herein, especially col. 1, lines 31 to 50. This, in turn, often leads to excessive porosities, coarse microstructures, or both in castings made from these alloys. Accordingly, shaped parts made from beryllium aluminum alloys are most commonly made by powder metallurgy techniques.

The above-mentioned Grensing et al. patent indicates that beryllium aluminum alloys suitable for investment casting can contain as little as 30 wt. % beryllium. However, experience has shown that beryllium contents of at least about 56 wt. % and more commonly about 61 to 69 wt. % are necessary to make commercially-acceptable alloys, i.e., alloys exhibiting acceptable levels of segregation and microporosity. For example, the three beryllium aluminum investment casting alloys available on the market today have beryllium contents of 56 to 68 wt. %. Note, also, that the alloys in all working examples of the Grensing et al. patent have beryllium contents of at least 62 wt. %. Also note the express disclosure in the Nachtrab et al., patent mentioned above that beryllium must be present in an amount of at least about 60 wt. %.

Two desirable properties of beryllium aluminum alloys are low coefficients of thermal expansion and high thermal conductivities. In this regard, all three commercial beryllium aluminum investment casting alloys mentioned above have coefficients of thermal expansion of about 14.5 μm/m (ppm) or less. In addition, two of these alloys have thermal conductivities of about 105 to 110 W/M-° K @30° C., while the third has a thermal conductivity of about 180 W/M-° K@30° C.

Beryllium is expensive. Therefore, it would be advantageous if the concentration of beryllium in these alloys could be reduced without adversely affecting their thermal or investment casting properties. And it would be especially desirable if this could be done in such a way that one or more of these thermal properties were actually improved.

SUMMARY

In accordance with this invention, it has been found that the beryllium content of beryllium aluminum alloys suitable for investment casting which contain a small but suitable amount of silver can be significantly reduced without adversely affecting their thermal or investment casting properties by including significantly more silicon in the alloy than done in the past.

Thus, this invention provides a new beryllium aluminum alloy suitable for investment casting purposes, the alloy comprising 40 to 55 wt. % Be, 3.0-11 wt. % Si, 1.2 to 5.0 wt. % Ag, and no more than 3 wt. % optional ingredients, with the balance being aluminum plus incidental impurities, wherein the Be/Al ratio of the alloy is ≤1.8, the Si/Al ratio of the alloy is and the combined amounts of Si and Ag in the alloy is ≥4.0 wt. %, and further wherein the alloy has a coefficient of thermal expansion of ≤14.5 μm (ppm) and a thermal conductivity of at least 150 W/M-° K@30° C.

DETAILED DESCRIPTION

The inventive beryllium aluminum investment casting alloys contain significantly less beryllium than known beryllium aluminum alloys exhibiting commercially desirable investment casting properties. Thus, the inventive beryllium aluminum alloys normally contain 55 wt. % or less beryllium, more commonly 50 wt. % or less. Normally, they also contain at least about 40 wt. % beryllium, because the modulus of elasticity and specific stiffness of beryllium aluminum alloys containing less beryllium are simply too low for many investment casting applications. Thus, the inventive beryllium aluminum investment casting alloys desirably exhibit a modulus of elasticity of at least about 140 GPa@25° C., preferably at least about 150 GPa@25° C. Alloys containing at least about 45 wt. % beryllium, and especially 47 to <50 wt. %, beryllium are particularly interesting, as are alloys exhibiting a modulus of elasticity of at least about 160 GPa@25° C.

In addition to beryllium, the inventive alloys also contain silver. As indicated above, as of this writing, there are three commercially-available beryllium aluminum investment casting alloys in the United States. Two contain about 1.65-3.35 wt. % silver, while the third contains no silver. In addition, the above-noted Nachtrab et al. patent indicates that beryllium aluminum alloys can contain up to 4.25 wt. % Ag. The inventive beryllium aluminum investment casting alloys contain similar amounts of silver as these silver-containing alloys. Thus, the inventive beryllium aluminum alloys contain at least 1.2 wt. % Ag, and more commonly at least 1.4 wt. % or even at least 1.65 wt. % Ag. In addition, they may contain as much as 5.0 wt. % Ag, but more commonly will contain no more than about 4.0 wt. %, no more than about 3.5 wt. % or even no more than about 3.0 wt. % Ag. Silver contents of about 1.65-3.35 wt. %, 1.4-2.7 wt. %, or even 1.65-2.35 wt. %, are more interesting.

In addition to beryllium and silver, the inventive beryllium aluminum alloys also contain silicon. Two of the commercial investment casting beryllium aluminum alloys mentioned above contain no silicon while the third contains about 1.65-2.5 wt. % silicon. Similarly, the above-noted Nachtrab et al. patent, although indicating that the silicon can be present in its alloys in amounts as high as 4 wt. %, shows in its working examples that silicon content as a practical matter is limited to a maximum of 2.0 wt. %. The inventive alloys differ from these alloys in that they contain significantly more silicon. Thus, the inventive alloys contain at least about 3.0 wt. % silicon, with alloys containing at least about 3.5 wt. % silicon or even at least about 4.0 wt. % silicon being more interesting. As for maximum silicon content, the inventive alloys can contain as much as 11 wt. % silicon, although they typically contain a maximum of about 8 wt. % silicon, 6 wt. % silicon or even 5 wt. % silicon.

The inventive beryllium aluminum alloys can also contain a variety of optional ingredients in total amount not exceeding 3.0 wt. %, preferably not exceeding 2.0 wt. %, 1.0 wt.% or even 0.5 wt. %. For example, the inventive alloys can contain one or more of nickel, cobalt and copper for solid solution strengthening. However, nickel and cobalt are also known to reduce the thermal conductivity, while copper is known to adversely affect the castability, of beryllium aluminum alloys. Therefore, the total concentration of these elements in the inventive alloys should not exceed 2.5 wt. %. Preferred alloys contain no more than 1.5 wt. %, 1.0 wt. % or even 0.5 wt. % of these elements. Especially preferred alloys are essentially free of these elements.

The inventive beryllium aluminum alloys can also contain elements known to increase ductility such as strontium, sodium, calcium and antimony. If so, the amount of such ingredients in these alloys should be no greater than 0.3 wt. %, more desirably no more than 0.25 wt. %. Alloys containing 0.005 to 0.2 wt %, 0.01 to 0.1 wt. %, or even 0.02 to 0.08 wt. % of these elements are more interesting. Alloys containing 0.02 to 0.06 wt. % or even 0.03 to 0.05 wt. % strontium are especially interesting.

Other known ingredients in beryllium aluminum alloys can be included in the inventive beryllium aluminum alloys. Examples include germanium, titanium, zirconium, boron, scandium, yttrium and the rare earth elements. If so, the total amount of such ingredients should not exceed 1.0 wt. %, preferably 0.5 wt. %, 0.3 wt. % or even 0.1 wt. %. Alloys which are essentially free of these ingredients are preferred.

The balance of the inventive alloys is aluminum and incidental impurities. By incidental impurities is meant ingredients which are present in such small amounts (usually trace amounts) that their effect on the properties of the alloy obtained are insignificant. As well appreciated in metallurgy, it makes no economic sense to refine out trace contaminants which have an insignificant effect on alloy performance. The same considerations apply here.

In accordance with this invention, it has been found possible to substantially reduce the beryllium content of silver-containing beryllium aluminum alloys suitable for investment casting purposes without adversely affecting their thermal or investment casting properties by including significantly more silicon in these alloy than done in the past. This compositional modification is reflected by at least three different features of the inventive alloys compared with conventional alloys.

First, the inventive alloys contain substantially less beryllium and correspondingly more aluminum, on a relative basis, than conventional alloys. This is reflected by the fact that, in the inventive alloys, the Be/Al ratio is ≤1.8, more desirably ≤1.4 or even ≤1.2. In contrast, in the silicon-containing commercial alloys mentioned above as well as all of the silicon-containing alloys specifically disclosed in the above-mentioned Grensing et al. and Nachtrab et al. patents, the Be/Al ratio is at least 2.0. The difference between the inventive and earlier alloys in terms of aluminum content is also reflected by the fact that the aluminum content of the inventive alloys is typically ≥36 wt. %, more commonly ≥39 wt. % and even ≥42 wt. %. In the silicon-containing commercial alloys mentioned above as well as all of the silicon-containing alloys specifically disclosed in the above-mentioned Grensing et al. and Nachtrab et al. patents, the maximum Al content is 33 wt. %.

The second difference between the inventive alloys and conventional alloys is that the inventive alloys contain more silicon on a relative basis. This is reflected by the fact that, in the inventive alloys, the Si/Al ratio is ≥0.07, more desirably ≥0.085 or even ≥0.1. In contrast, in all of the silicon-containing commercial alloys mentioned above and in all the silicon-containing alloys specifically disclosed in the Grensing et al. and Nachtrab et al. patents, the maximum Si/Al ratio is 0.065.

The third difference between the inventive alloys and conventional alloys is that the combined amount of silicon and silver in the inventive alloys is greater than in conventional alloys. This is reflected by the fact that, in the inventive alloys, the combined amount of Si and Ag is ≥4.0 wt. %, more desirably ≥5.0 wt. %, or even ≥6.0 wt. %. Although the general disclosure of the above-noted Nachtrab et al. patent indicates its alloys can contain up to 4 wt. % Si and up to 4.25 wt. % Ag, the working examples of this patent show that the combined amount of these elements is limited to a maximum of 4.0 wt. %. Meanwhile, the maximum combined amount of Si and Ag in the above-noted commercial alloys, as well as the alloys described in the above-noted Grensing et al. patent, is 4.85 wt. %.

From the above, it can be seen that the inventive alloys differ from conventional beryllium aluminum alloys suitable for investment casting purposes in that the inventive alloys not only contain less beryllium and more aluminum than their conventional counterparts but also more silicon both on an absolute basis as well as on a relative basis with respect to their aluminum contents. It is well known that the microstructure of a beryllium aluminum alloy is composed of a beryllium phase (beryllium-based dendrites) surrounded by an aluminum matrix. Although not wishing to be bound to any theory, it is believed that the increased amounts of aluminum and silicon in the inventive alloys generate a modified microcrystalline structure in which the beryllium phase is surround by an aluminum silicon eutectic phase which also contains primary aluminum cells, i.e., cells of essentially pure aluminum. This aluminum silicon eutectic, it is believed, is responsible not only for the low microporosity and relatively fine grain structure exhibited by the inventive beryllium aluminum alloys but also their improved thermal properties.

In this regard, the inventive beryllium aluminum alloys exhibit a desirably low coefficient of thermal expansion of ≤14.5 μm/m (ppm), more desirably ≤14.2 μm (ppm), ≤14.0 μm (ppm) or even ≤13.8 μm/m (ppm). In addition, they also exhibit a superior thermal conductivity of at least 150 W/M-° K@30° C., more desirably at least 165 W/M-° K@30° C. and even at least 180 W/M-° K@30° C. This low coefficient of thermal expansion is essentially as good as that exhibited by the above mentioned commercial alloys, while this superior thermal conductivity is better than that exhibited by such alloys in most instances. That is to say, preferred beryllium aluminum alloys of this invention exhibit thermal conductivities of at least 185 W/M-° K@30° C. or higher, which is more than other known beryllium aluminum alloys.

WORKING EXAMPLES

In order to more thoroughly describe this invention, the following working examples are provided. In each of these working examples, beryllium aluminum alloys were made by the general procedure described in the above-noted Grensing et al. patent in which castings of each alloy were made by charging a superheated molten mass of the alloy into a heated mold under suitable vacuum conditions. After cooling and removal from the mold, each alloy was subjected to a series of standard analytical tests to determine its properties.

Four different alloys were tested. Three of these alloys represented the conventional commercially-available alloys mentioned above, these alloys being to referred to as Commercial Alloy A ("CA-A"), Commercial Alloy B ("CA-B"), and Commercial Alloy C ("CA-C"). A fourth alloy representing this invention was also tested.

The compositions of these alloys as well as the results obtained are set forth in the attached Table 1. For the purposes of comparison, the chemical composition of the alloy shown in Example 5 of the above-noted Grensing et al. patent is also included in Table 1.

TABLE 1

Composition and Properties of Alloys in Working Examples

| | | Gr Ex 5 | CA-A | CA-B | CA-C | Invent |
|---|---|---|---|---|---|---|
| Composition | | | | | | |
| Be | wt. % | 64 | 61.1-68.6 | 56-63 | 61.1-68.6 | 49.5 |
| Al | wt. % | 30 | bal (~31) | bal (~47) | bal (~30) | 44 |
| Si | wt. % | 1.4 | 1.65-2.50 | | | 4.5 |
| Ag | wt. % | 1.5 | 1.65-2.35 | | 2.65-3.35 | 2.0 |
| Ni/Co/Cu | wt. % | 3 Ni | | 2.4-3.2 Ni | 0.65-1.35 Co | |
| other | wt. % | 0.1 Ti | | | 0.55-0.95 Ge | 0.04 Sr |
| Be/Al | | ~2.1 | ~2.1 | ~1.28 | ~2.2 | 1.125 |
| Si/Al | | 0.047 | 0.05 | | | 0.102 |
| Ag + Si | wt. % | 2.9 | 3.30-4.85 | | 2.65-3.35 | 6.5 |
| Properties | | | | | | |
| Density | g/cm$^3$ | | 2.16 | 2.16 | 2.16 | 2.21 |
| Melt (Liquidus) | ° C. | | 1287 | 1287 | 1287 | 1287 |
| Coefficient of Thermal Expansion | μm/m (ppm) | | 13.4 | 14.6 | 14.2 | 13.6 |
| Thermal Conductivity | W/M-° K @ 30° C. | | 180 | 110 | 105.5 | 186 |
| Modulus of Elasticity in Tension | GPa @ 25° C. | | 202 | 202 | 202 | 167 |
| Specific Stiffness | GPa @ 25° C. | | 93.5 | 93.5 | 93.5 | 75.5 |
| 0.2% YS | MPa | | 137.9 | 151.7 | 200 | 145 |
| UTS | MPa | | 196.5 | 200 | 255 | 200 |
| % Elongation | % @ 25° C. | | 1.7 | 5.4 | 3.4 | 3.0 |

From Table 1, it can be seen that the amount of beryllium in the inventive beryllium aluminum alloy is about 23% less than the commercial alloys containing silicon (including the silicon-containing alloy of the Grensing patent) and over 17% less than the commercial alloy containing no silicon or silver. Since beryllium is expensive, this means that the inventive alloy is significantly less expensive to make than these commercial alloys.

From Table 1, it can also be seen that the inventive alloy has mechanical properties such as 0.2% Yield Strength, Ultimate Tensile Strength and % Elongation comparable to that of the commercial alloys. In addition, it also has a low coefficient of thermal expansion comparable to these alloys. In terms of thermal conductivity, however, the inventive alloy is superior in that its thermal conductivity is better than that of Commercial Alloy A and substantially better than that of Commercial Alloys B and C.

This data shows that, by formulating the inventive alloys as described herein, not only is it possible to substantially reduce the beryllium content of the alloys obtained, but in addition it is also possible to do so in a way which preserves the investment casting properties of the alloys while improving their thermal properties at the same time.

Although only a few embodiments of this invention have been described above, it should be appreciated that many modifications can be made without departing from the spirit and scope of this invention. All such modifications are intended to be included within the scope of this invention, which is to be limited only by the following claims.

The invention claimed is:

1. A beryllium aluminum alloy suitable for investment casting purposes, the alloy comprising 40 to 55 wt. % Be, 3.0-11 wt. % Si, 1.2 to 5.0 wt. % Ag, and no more than 3 wt. % optional ingredients, with the balance being aluminum plus incidental impurities, wherein the Be/Al ratio of the alloy is ≤1.8, the Si/Al ratio of the alloy is ≥0.07, and the combined amounts of Si and Ag in the alloy is ≥5.0 wt. %, and further wherein the alloy has a coefficient of thermal expansion of ≤14.5 μm/m (ppm) and a thermal conductivity of at least 150 W/M-° K@30° C.

2. The alloy of claim 1, wherein the Be/Al ratio is ≤1.4.

3. The alloy of claim 2, wherein the Be/Al ratio is ≤1.2.

4. The alloy of claim 1, wherein the Si/Al ratio is ≥0.085.

5. The alloy of clam 4, wherein the Si/Al ratio is ≥0.1.

6. The alloy of claim 1, wherein the combined amounts of Si and Ag is ≥6.0 wt. %.

7. The alloy of claim 1, wherein the thermal conductivity of the alloy is at least 165 W/M-° K@30° C.

8. The alloy of claim 7, wherein the thermal conductivity of the alloy is at least 180 W/M-° K@30° C.

9. The alloy of claim 1, wherein the alloy contains 45 to 55 wt. % Be, 3.5-6.0 wt. % Si, 1.4 to 4.0 wt. % Ag, and no more than 1.5 wt. % optional ingredients, with the balance being aluminum plus incidental impurities, wherein the Be/Al ratio is ≤1.4, the Si/Al ratio is ≥0.085, and the alloy has a thermal conductivity of at least 165 W/M-° K@30° C.

10. The alloy of claim 9, wherein the alloy contains 47.5 to ≤50 wt. % Be, 4.0-5.0 wt. % Si, 1.65-2.35 wt. % Ag, and no more than 0.5 wt. % optional ingredients, with the balance being aluminum plus incidental impurities, and wherein the Be/Al ratio is ≤1.4, the Si/Al ratio is ≥0.085, and the alloy has a thermal conductivity of at least 180 W/M-° K@30° C.

11. The alloy of claim 9, wherein the alloy contains 0.01 to 0.1 wt. % strontium, sodium, calcium, antimony or mixtures thereof.

12. The alloy of claim 11, wherein the alloy contains 0.02 to 0.06 wt. % strontium.

13. The alloy of an claim 1, wherein the alloy is essentially free of Co, Ni and Cu.

* * * * *

UNITED STATES PATENT AND TRADEMARK OFFICE

CERTIFICATE OF CORRECTION

PATENT NO. : 8,980,168 B2
APPLICATION NO. : 13/398234
DATED : March 17, 2015
INVENTOR(S) : Randolf S. Beals It is certified that error appears in the above-identified patent and that said Letters Patent is hereby corrected as shown below:

In the Claims

Column 6, line 35, claim 1, insert --3.0-11 wt.% Si, 1.2 to 5.0 wt.% Ag, and no more than 3 wt.% optional ingredients, with the balance being aluminum plus incidental impurities, wherein the Be/Al ratio of the alloy is--;

Column 6, line 44, claim 6, delete “amounts” and insert therefor --“amount”--;

Column 6, line 58, claim 10, delete “≤” and insert --<-- before “50”.

Signed and Sealed this
Twenty-third Day of June, 2015

Michelle K. Lee

Michelle K. Lee
*Director of the United States Patent and Trademark Office*